US008210761B2

(12) United States Patent
Bouix et al.

(10) Patent No.: US 8,210,761 B2
(45) Date of Patent: Jul. 3, 2012

(54) COSMETIC PACKAGE WITH INTEGRALLY MOLDED WIPER

(75) Inventors: Herve F. Bouix, New York, NY (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 452 days.

(21) Appl. No.: 12/489,627

(22) Filed: Jun. 23, 2009

(65) Prior Publication Data

US 2010/0166488 A1 Jul. 1, 2010

Related U.S. Application Data

(60) Provisional application No. 61/075,798, filed on Jun. 26, 2008.

(51) Int. Cl.
*A46B 17/08* (2006.01)
*A46B 11/00* (2006.01)

(52) U.S. Cl. ..... 401/122; 401/129

(58) Field of Classification Search ..... 401/122, 401/118, 126, 129
See application file for complete search history.

(56) References Cited

U.S. PATENT DOCUMENTS 572,327 A 12/1896 Bryan
586,283 A * 7/1897 Cole ..... 401/129
2,547,779 A 4/1951 Renyck
2,814,420 A 11/1957 Elder, Jr. et al.
3,128,920 A 4/1964 Volckening et al.
3,204,835 A 9/1965 Michel
3,469,928 A 9/1969 Widegren
3,777,949 A 12/1973 Chiquiari-Arias
4,248,227 A 2/1981 Thomas
4,284,199 A 8/1981 Bigarella
4,711,354 A 12/1987 Bennett
4,732,287 A 3/1988 Bennett
4,786,534 A 11/1988 Aiken
4,889,228 A 12/1989 Gueret
4,952,204 A 8/1990 Korteweg
4,982,838 A 1/1991 Fitjer (Continued)

FOREIGN PATENT DOCUMENTS

JP 2004-187901 7/2004

OTHER PUBLICATIONS

PCT International Search Report; International Application No. PCT/US2009/048472; Completion Date: Feb. 11, 2010; Date of Mailing: Feb. 12, 2010.

(Continued)

*Primary Examiner* — David J. Walczak
*Assistant Examiner* — Bradley Oliver
(74) *Attorney, Agent, or Firm* — Martin W. Haerter

(57) ABSTRACT

A rigid low cost cosmetic container is provided wherein the basic elements, a tubular container and an applicator wand, are integrally formed as a unitary body. The wand extends inwardly from the top of the container into a product reservoir to form of an applicator end. The wand extends upwardly from the top end of the container to form a handle which may be provided in dimensions approximating the cap on a saleable package. The container and wand are separated by a frangible connection in the top end of the container. The bottom margin of the container sidewall is provided with a substantially reduced thickness to permit the container to be pinched and hermetically sealed after the product reservoir is filled with a quantity of product.

12 Claims, 2 Drawing Sheets

U.S. PATENT DOCUMENTS

| | | | | |
|---|---|---|---|---|
| 5,320,217 | A | 6/1994 | Lenarz | |
| 5,765,574 | A | 6/1998 | Sheffler et al. | |
| 5,826,600 | A | 10/1998 | Rowe et al. | |
| 5,862,818 | A | 1/1999 | Marinelli | |
| 6,039,487 | A | 3/2000 | Kristiansen | |
| 6,077,579 | A | 6/2000 | DeLaforcade | |
| 6,305,385 | B1 | 10/2001 | Szekely | |
| 6,326,069 | B1 | 12/2001 | Barnett et al. | |
| 6,474,980 | B2 * | 11/2002 | LaVanier | 431/126 |
| 6,572,296 | B2 | 6/2003 | Schrepf | |
| 6,685,013 | B2 | 2/2004 | Discko, Jr. | |
| 6,709,181 | B1 | 3/2004 | Montoli | |
| 7,008,133 | B2 | 3/2006 | Ashe et al. | |
| 7,219,801 | B2 | 5/2007 | Christian | |
| 7,223,035 | B1 * | 5/2007 | Engel | 401/122 |
| 2003/0077104 | A1 * | 4/2003 | Schrepf | 401/129 |
| 2006/0165472 | A1 | 7/2006 | Dumler | |
| 2006/0283728 | A1 | 12/2006 | Patrick et al. | |
| 2012/0003064 | A1 * | 1/2012 | Voser et al. | 414/217 |

OTHER PUBLICATIONS

PCT Written Opinion of the International Searching Authority, or the Declaration; International Application No. PCT/US2009/048472; Completion Date: Feb. 11, 2010; Mailing Date: Feb. 12, 2010.

* cited by examiner

COSMETIC PACKAGE WITH INTEGRALLY MOLDED WIPER

CROSS-REFERENCE TO RELATED APPLICATIONS

This application claims priority from U.S. provisional application 61/075,798, filed Jun. 26, 2008.

BACKGROUND OF THE INVENTION

1. Field of the Invention

The present invention relates to cosmetic product packages. In particular, the present invention is directed to a cosmetic product package molded with an integral wiper means for metering the dispensed product.

2. Description of the Prior Art

Low cost containers serve at least two important roles in the cosmetic field, i.e., as unit-dose dispensers or as samplers. Unit-dose dispensers conveniently provide to the user a pre-measured amount of product, e.g., enough product for a single treatment or application. Samplers (sample size packages of product) are generally provided to consumers free of charge so that a consumer can experience a limited quantity of a product prior to making a purchase decision. With respect to samplers, it is important that the experience of sampling the product closely approximates the experience of using a saleable package (the package available for purchase).

Present samplers are often smaller versions of saleable packages. For example, mascara product samplers are often reduced volume versions of the saleable package, complete with a saleable-type re-sealable container with a threaded neck and cap, a rod, a brush applicator and an elastomer wiper insert. The cost of such samplers is relatively high due to the number and quality of parts (bottle, cap, rod, brush, wiper), complexity of structure, assembly and filling.

Alternative samplers may be made by blow molding, extrusion or vacuum forming less expensive bottles, squeeze tubes or blister packs, respectively. However, these less expensive alternatives fail to provide a quality sampling experience that closely approximates the experience of using a saleable package. Furthermore, because these alternative sampler packages are generally non-rigid, the user may inadvertently apply too much pressure to the package and accidentally release or expel an undesired portion of product.

U.S. Pat. Nos. 4,732,287 and 4,711,354 to Bennett, respectively, disclose cosmetic dispensers including an elongated hollow cylindrical container with an opening, and an elongated plastic article (applicator rod) provided in the container with an enlarged portion sealed or welded in the opening of the container. The basic dispenser requires at least two main components, the cylindrical container and the article (applicator rod), that are separately manufactured and subsequently assembled, thus increasing production cost. A wiper dimensioned to meter product does not appear to be provided.

U.S. Pat. No. 2,814,420 to Elder, Jr., et al. discloses a sealed package and container with a tubular body, an frusto-conical section extending into one end of the body and a stem joined by a breakable annular zone to the frusto-conical section. The body, frusto-conical section and stem are formed as a unitary part. The tubular body is squeezable to facilitate expelling product from the product reservoir. Accordingly, product could be inadvertently expelled during normal handling if the user inadvertently applies excessive pressure. To avoid this problem, the frusto-conical section is inverted by the user from a position extending into the body to a position extending outwardly from the body. While this feature would appear to reduce the incidence of inadvertent release of product, it may not totally eliminate the problem. In addition, the stem does not extend down below the frusto-conical section, so it appears that it would be difficult if not impossible for the stem to be dipped into the product in the container. It appears as if the stem, in order to be used as an applicator, would need to be loaded with product by squeezing product from tubular body.

U.S. Pat. No. 6,039,487 to Kristiansen discloses a disposable dispenser comprised of a tube extending from an upper end of a container. An open bottom end of the container is sealed after the container is charged with product. Prior to filling and sealing, an applicator rod is inserted into the tube, which is adapted to internally receive in friction fit the upper end of the applicator rod. The region where the tube and the neck of the container are joined is weakened so that the tube can be snapped away from the container. There does not appear to be a wiper dimensioned to meter product.

U.S. Pat. No. 4,952,204 to Kortweg discloses a dry handle swab assembly and unit. Kortweg is substantially the same as that disclosed in Kristiansen—a tube extending from an upper end of a container with an applicator rod secured in the tube. Kortweg does not disclose a wiper.

U.S. Pat. No. 5,826,600 to Rowe et al. discloses a disposable dry-handle mascara applicator assembly that is substantially the same as that disclosed in Kristiansen—a tube extending from an upper end of a container with an applicator rod secured in the tube. Rowe et al. discloses a wiper dimensioned to remove excess product from the applicator brush as the applicator rod is withdrawn from the package. Unfortunately, the wiper arrangement in Rowe et al. appears to be a one-way arrangement. Any attempt to return the applicator brush into the package through the wiper would result in excess mascara being deposited on the outside of the package. Clearly this would be an undesirable outcome to a user.

U.S. Pat. No. 6,709,181 to Montoli discloses a mascara product sampler substantially similar in construction to a saleable package, i.e., complete with a re-sealable container with a threaded neck and cap, a rod, a brush applicator and an elastomer wiper insert. The relative complexity of the manufacturing and assembly is self-evident.

Accordingly, there is a need for a less complex, rigid container made in a minimal number of pieces, and which includes a wand with an applicator extending into a product reservoir and an integral wiper capable of metering product withdrawn from the package with the applicator.

BRIEF SUMMARY OF THE INVENTION

It is an object of the invention to provide a cosmetic container that is simple and substantially complete in a minimal number of parts.

It is another object of the invention to provide a cosmetic container suitable for use as a saleable, a sampler or a unit-dose dispenser.

It is yet another object of the invention to provide a basic two-piece cosmetic container whose function can be enhanced with the addition of conventional applicator heads, e.g., a twisted wire mascara brush.

It is another object of the invention to provide a cosmetic container with a product reservoir body that is sufficiently rigid to protect an applicator stored inside the body, and to prevent product ejection during use.

It is another object of the invention to provide a low cost cosmetic container that substantially imitates the look and feel of a more costly container.

Accordingly, a rigid cosmetic container is provided wherein the basic elements, a rigid tubular container, a neck and a wiper dimensioned to meter product, are integrally formed as a first unitary body. The neck is adapted to receive a closure. An annular wiper depends internally from the neck. The wiper has a bore in fluid alignment with the neck passage. The bore has a predetermined size selected to meter product as a wand is withdrawn, e.g., to remove excess product from the applicator, or to distribute product more evenly on the applicator. A side wall depends externally from the neck to form a rigid housing defining a product storage reservoir. The side wall terminates at a bottom margin defining a bottom end of the body. A first substantially rigid tubular portion of the side wall between the neck and the bottom margin has a first thickness sufficient to substantially resist deformation. A second portion of the side wall including the bottom margin has a second thickness less than the first thickness, the second thickness selected to permit pinching of the bottom margin to hermetically seal the bottom end of the body.

A wand is provided in the form of a second unitary body that includes a cap (the closure) and a stem with an applicator end. The stem is adapted to extend downwardly from the cap through the wiper and into the product reservoir.

The applicator end of the wand may be used as is, e.g., as a dipper to retrieve product, or the end may be enhanced with texture (e.g., grooves, ridges, bores, bumps) or a spatula-like flattened portion to enhance product loading and/or delivery of product. Alternatively, the applicator end may be enhanced by securing an applicator to it. For example, a sponge, a fibrous material, flocking or a brush may be secured to the applicator end to enhance loading and delivery of the product sample.

Although the cosmetic container of the present invention appears to be a squeeze-tube type container, the container is actually substantially rigid, i.e., it is substantially inflexible under pressures associated with typical manipulation of packages of this type. Accordingly, the product and applicator are well protected, and inadvertent spillage or product ejection during handling is substantially eliminated.

DETAILED DESCRIPTION OF THE INVENTION

Figure 1:
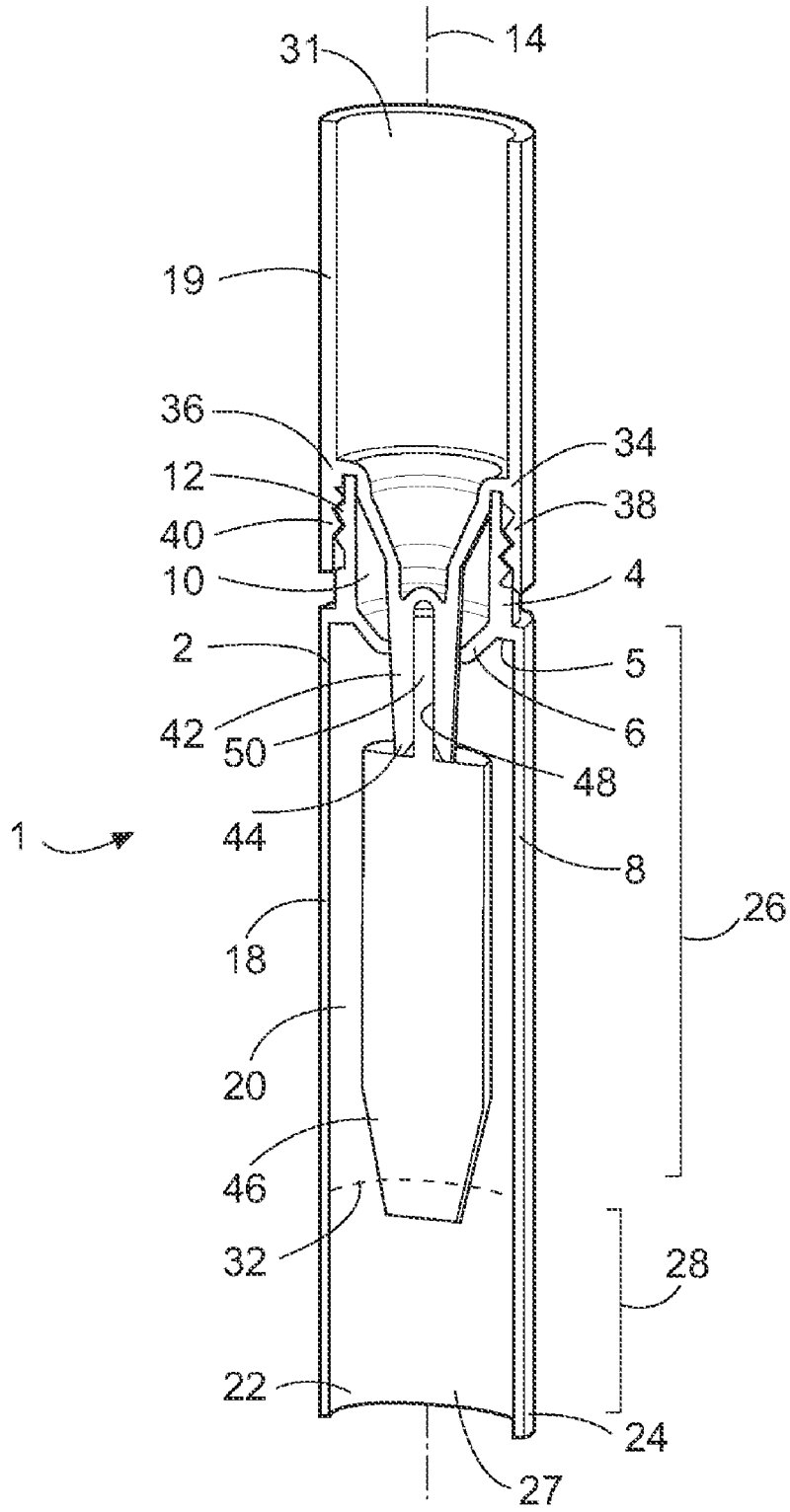
FIG. 1 is a cross-sectional, perspective view of the cosmetic package of the present invention.
Figure 3:
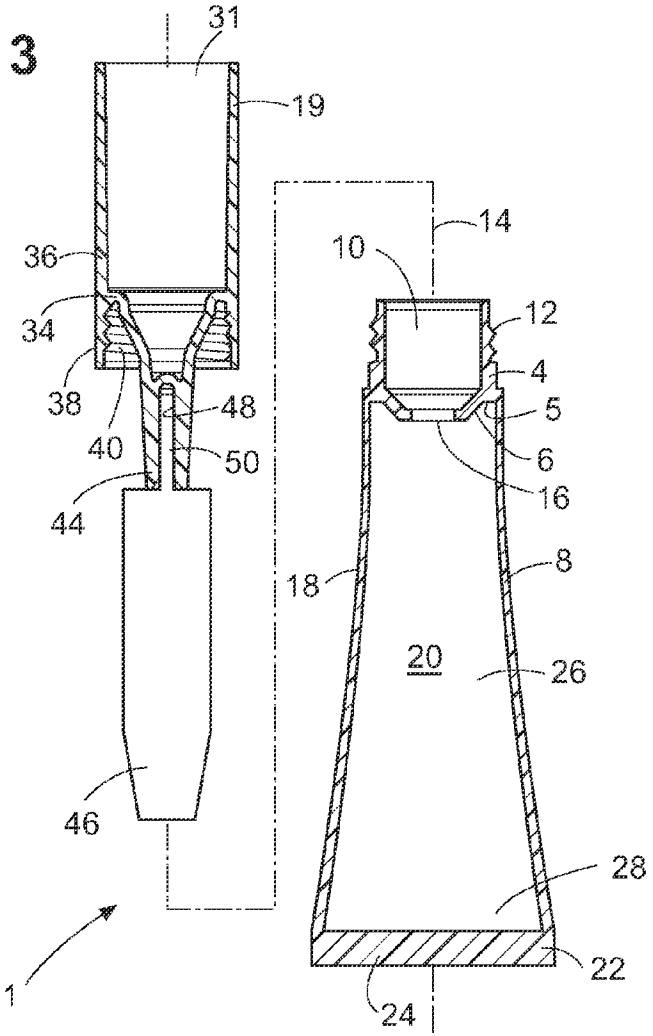
FIG. 3 is a cross-sectional view of the cosmetic package with the wand removed.
Figure 2:
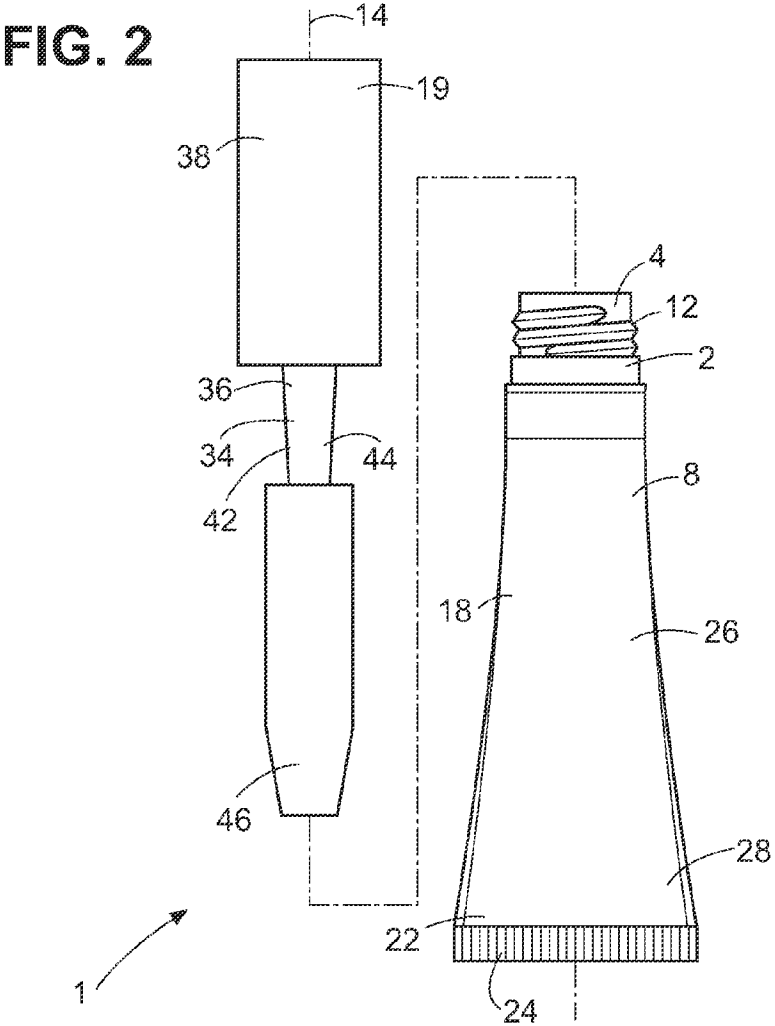
FIG. 2 is an elevation view of the cosmetic package with the wand removed.

Referring now to FIGS. 1-3, a cosmetic container is shown generally at reference number 1. The cosmetic container comprises an integrally molded unitary first body 2 that includes a neck 4, an annular wiper 6 and a side wall 8. A top end wall 5 may be provided between the neck and the side wall 8, or the side wall 8 may depend directly from the neck 4 with no intervening structure. The neck 4 defines a neck passage 10. The neck 4 is adapted to receive a cap by, for example, being provided with external threads 12. The neck 4 further defines a longitudinal axis 14 through the neck passage 10. The annular wiper 6 depends internally from the neck 4. The wiper 6 has a bore 16 aligned on the longitudinal axis and in fluid alignment with the neck passage 10. The bore 16 has a predetermined size suitable for metering product withdrawn from the container. The side wall 8 depends externally from the neck 4 to form a tubular housing 18 defining a product reservoir 20 that is in fluid communication with the bore 16 and neck passage 10. The side wall terminates at a bottom margin 22 defining a bottom end 24 of the first body 2. The bottom end 24 defines a temporary fill passage 27 that provides alternate access to the product reservoir 20. A substantially rigid tubular first portion 26 of the side wall 8 between the neck 4 and the bottom margin 22 has a first thickness sufficient to resist deformation. A second portion 28 of the side wall including the bottom margin 22 has a second thickness less than the first thickness, the second thickness selected to permit pinching of the bottom margin 22 to close the temporary fill passage 27 and hermetically seal the bottom end 24 of the first body 2 (as shown in FIGS. 2 and 3) after the product reservoir 20 is filled through the fill passage 27. The top of the second portion 28 of the side wall 8 is indicated approximately by broken line 32. From the line 32, the second portion 28 continues down to the bottom end 24. The second thickness may be constant through the height of the second portion 28, or it may gradually taper to become thinner as it approaches the bottom end 24.

A wand 34 is provided in the package. The wand includes an integrally molded unitary second body 36. The unitary second body 36 has a cap 38, a stem 42 and an applicator end 44. The cap 38 is at a first end of the second body 36. The cap 38 is adapted to be received and secured on the neck 4 by, for example, internal threads 40 dimensioned to cooperate with the external threads 12 on the neck 4. A stem 42 depends from the cap 38 to an applicator end 44. When the cap 38 is secured on the neck 4, the stem 42 extends through the neck 4 and wiper 6 along the longitudinal axis 14 to position the applicator end 44 in a portion of the product storage reservoir 20 protected by the first substantially rigid tubular portion 26 of the side wall 8.

An applicator 46 may be secured to the applicator end 44. The applicator 46 may comprise any well known applicator form or structure, such as, for example, a sponge, a fibrous pad, a brush, an elastomer paddle, etc. Preferably, the applicator is a twisted wire core mascara brush (illustrated schematically in FIGS. 1-3).

The predetermined size of bore 16 in the wiper 6 is selected to meter product when the wand 34 is withdrawn from the container. The terms meter or metering are to be understood to mean that the bore is selected to, for example, effect the amount or distribution of product on the applicator end of the wand, or the applicator attached to the applicator end of the wand. For example, the wiper removes excess product, or re-distributes product more evenly on the applicator end or the applicator.

The product reservoir 20 may be filled after the bottom margin 22 has been pinched and hermetically sealed (a sealed bottom margin is illustrated in FIGS. 2 and 3). In this case, the product reservoir would be filled by injecting product through the neck 4, i.e., through the bore 16 in the wiper 6. Subsequent to filling, the cap 38 would be installed securely on the neck to seal the product in the package.

Alternatively, the cap 38 can be securely installed prior to filling the product reservoir. In this alternative case, the product reservoir would be filled by injecting product through the temporary fill passage 27. Subsequent to filling the product reservoir, the bottom margin 22 would be pinched and hermetically sealed.

The bottom margin 22 is sealed, for example, by heating to soften the reduced wall thickness of the second portion 29 of the side wall 8. The bottom margin is then pinched together to bond by sonic welding, hot melt, adhesive or other known method. In the preferred embodiment, the bottom margin 22 is pinched or clamped under heat and pressure to hermetically seal the fill passage 27 by welding an approximately 5 mm wide section along the lower edge of the bottom margin 22.

Each of the unitary first body 2 and unitary second body 36 is integrally formed as a single unit by injection molding. This greatly reduces the cost of manufacturing.

The applicator end 44 of the wand 34 may be utilized as a dipper, to load cosmetic product and transport it to a treatment area on the user. Alternatively, to enhance product loading and delivery, the applicator end can be enhanced with texture, e.g., holes, grooves, bumps, patterns or recesses, or shaped, e.g., a spatula (not shown). However, the applicator end 44 is preferably further adapted as shown in FIGS. 1-3 to facilitate loading, transport and application of cosmetic product by, for example, securing an applicator 46 (shown schematically) to the applicator end 44. The applicator 46 can take the form of a fiber or foam pad, a sponge, a brush, a spatula, a flocked tip, a shaped elastomer tip or any other means suitable for loading, transporting and applying cosmetic products. The applicator 46 can be secured by conventional means, such as press fit, adhesive or sonic welding. Preferably, the applicator end 44 is adapted to support an applicator 46 by, for example, providing a clearance 48 dimensioned to receive a core 50 of an applicator 46 (FIG. 3). The core may take the form of a twisted wire core, as for example, the wire core of a typical mascara brush. The core may be secured in the clearance by any suitable means including, but not limited to, adhesive, sonic welding, press fit, or heat treatment.

Although in the preferred embodiment the filled and sealed cosmetic container of the present invention appears to be a squeeze-tube type container (see FIGS. 2-3), the container is actually substantially rigid, i.e., it is substantially inflexible under pressures associated with typical manipulation of packages of this type. The rigidity of the container results from several factors. First, the unitary first body 2 is injection molded. Injection molded containers of this size and type tend to be more rigid than, for example, extruded, blow molded or vacuum formed containers. Rigidity is further enhanced by selecting a material for the unitary first body 2 and a thickness dimension for the sidewall 8 between the neck 4 and the bottom margin 22 to substantially resist deformation. The material and thickness of the side wall 8 are also selected to maximize compatibility with the product and prevent breakage.

One advantage of making the container substantially rigid is that the applicator 46 is protected from damage or deformation. This is particularly important for precision applicators such as the twisted wire mascara brush applicator. The bristles of such a brush can be damaged or deformed by constant or repeated undesired contact with flexible container walls. Another very important advantage of a rigid container is that it prevents the user from inadvertently squeezing product out through the neck 4. This prevents inconvenient spills or stains that may result from unexpected product discharge from the container.

A disadvantage of making the container substantially rigid is that hermetic sealing of the bottom of the package is substantially more difficult due to the inflexibility of the sidewall 8. The present inventors have overcome this difficulty by reducing the thickness in the sidewall 8 in the second portion 28 of the sidewall close to the bottom margin 22 of the sidewall (i.e., approximately below broken line 32). Accordingly, the sidewall 8 in the first portion, between the neck 4 and broken line 32 has a first thickness sufficient to resist deformation when gripped or squeezed under normal use. The sidewall 8 in second portion, between the broken line 32 and the bottom end 24 has a second thickness less than the first thickness. The second thickness is selected to accommodate deformation of the side wall 8 sufficiently to permit hermetic sealing of the fill passage 27. In the preferred embodiment, the bottom margin 22 is pinched under heat and pressure to hermetically seal the fill passage 27 by welding, either before or after product has been filled into the product storage reservoir 20.

As an alternative to pinching the bottom margin 22 to seal the fill passage, a plug dimensioned to fit in the fill passage 27 can be inserted. The plug can be hermetically secured to the bottom margin 9 by adhesive, welding, press-fit or other suitable means.

The cap 38 is provided with an upwardly directed, expanded hollow shell 19 that provides a handle for the user to grasp. The shell 19 closely approximates the dimensions of a typical cap on a more costly cosmetic package. The present invention provides to the consumer a relatively low-cost product package with the look and feel of a more expensive item, and thus gives the consumer in a less expensive package a quality product experience that closely approximates the experience of the higher cost packaging. The hollow shell 19 has an open end 31. To improve the appearance of the hollow shell handle, the open end 31 may be closed with an appropriately sized plug that can be secured by adhesive, welding or press-fit.

For use as a mascara container, the bore 16 in wiper 6 may have a diameter approximately in the range of 3.5 mm to 4.5 mm. Other cosmetics or applicators may require a larger or smaller opening, as appropriate.

The unitary first body and unitary second body are each preferably made in a single piece by injection molding. The preferred material is high-density polyethylene (HDPE). Alternatively, the material may be low-density polyethylene (LDPE), polypropylene (PP) or other suitable plastic material. For each body, a mold comprising two or more sections is provided with a cavity dimensioned to form the respective body. Suitable molten plastic is injected into the respective cavity through gates. The gates are positioned to facilitate flow of the molten plastic to all parts of the cavity. The mold is cooled sufficiently to allow the molten plastic to harden. The parts of the mold are then separated to release the completed unitary body. After the unitary bodies are formed, an applicator (if desired) is secured to the applicator end of the wand. The applicator can be secured to the wand prior to insertion of the stem into the container through the wiper. Alternatively, the wand can be secured on the neck and the applicator can be secured to the applicator end of the wand through the temporary fill passage 27. As another alternative, prior to injecting molten plastic into the mold for the second body (the wand), an applicator such as, for example, a mascara brush, can be mounted in the mold such that the core of the brush projects into the portion of the cavity adapted to form the applicator end of the wand. Molten plastic is subsequently injected such that the unitary second body is formed, including the applicator end of the wand with the mascara brush core securely embedded therein. Thus the core of the mascara brush is over-molded into final position. This method eliminates the need to separately install the mascara brush in the applicator end after the unitary second body is formed.

The cosmetic container of the present invention serves as an excellent, low cost package suitable for use as a sampler, a single-use package or as a saleable package. It provides a user with a quality product experience that closely approximates the experience of a more costly saleable package. The package can be used for mascara, lip gloss, eye shadow, lip liner, rouge, foundations, treatment products such as wrinkle reducers or spot removers. The present invention provides an ideal package for any cosmetic products that would benefit from a low cost packaging solution.

It is understood that various modifications and changes in the specific form and construction of the various parts can be made without departing from the scope of the following claims.

What is claimed is:

1. A cosmetic container comprising:

an integrally molded unitary first body including:

a neck defining a neck passage, the neck adapted to receive a cap, the neck further defining a longitudinal axis through the neck passage;

an annular wiper depending internally from the neck, the wiper having a bore in fluid alignment with the neck passage, the bore having a predetermined size; and a side wall depending externally from the neck to form a housing defining a product storage reservoir, the side wall terminating at a bottom margin defining a bottom end of the body, a substantially rigid tubular first portion of the side wall between the neck and the bottom margin having a first thickness sufficient to resist deformation, and a substantially rigid second portion of the side wall including the bottom margin having a second thickness less than the first thickness, the second thickness selected to permit pinching of the bottom margin to hermetically seal the bottom end of the body.

2. The cosmetic container of claim 1 wherein the neck further comprises external threads to receive a closure.

3. The cosmetic container of claim 1 further comprising a wand in the form of an integrally molded unitary second body, the wand having a cap at a first end, the cap adapted to be received and secured on the neck, and a stem depending from the cap to an applicator end, wherein when the cap is secured on the neck, the stem extends through the neck and wiper to position the applicator end in a portion of the product storage reservoir formed by the first substantially rigid tubular portion of the side wall.

4. The cosmetic container of claim 2 further comprising a wand in the form of an integrally molded unitary second body, the wand having a cap at a first end, the cap having internal threads adapted to be received and secured on the external threads of the neck, and a stem depending from the cap to an applicator end, the stem extending through the neck and wiper to position the applicator end in a portion of the product storage reservoir formed by the first substantially rigid tubular portion of the side wall.

5. The cosmetic container of claim 2 further comprising an applicator secured to the applicator end.

6. The cosmetic container of claim 5 wherein the applicator is a twisted wire core mascara brush.

7. The cosmetic container of claim 3 further comprising an applicator secured to the applicator end.

8. The cosmetic container of claim 7 wherein the applicator is a twisted wire core mascara brush.

9. The single-use cosmetic container of claim 1 wherein the predetermined size is further selected to meter product when the wand is withdrawn from the container.

10. A cosmetic container comprising:

an integrally molded unitary first body including:

a neck defining a neck passage, the neck adapted to receive a closure, the neck further defining a longitudinal axis through the neck passage;

an annular wiper depending internally from the neck, the wiper having a bore in fluid alignment with the neck passage, the bore having a predetermined size; and a side wall depending externally from the neck to form a housing defining a product storage reservoir, the side wall terminating at a bottom margin defining a bottom end of the body, a substantially rigid tubular first portion of the side wall between the neck and the bottom margin having a first thickness sufficient to resist deformation, and a substantially rigid second portion of the side wall including the bottom margin having a second thickness less than the first thickness, the second thickness selected to permit pinching of the bottom margin to hermetically seal the bottom end of the body; and a wand comprising an integrally molded unitary second body, the wand having a cap at a first end, and a stem depending from the cap to an applicator end, the cap adapted to be received and secured on the neck, wherein when the cap is received on the container, the stem extends through the neck and wiper to position the applicator end in a portion of the product storage reservoir formed by the first substantially rigid tubular portion of the side wall.

11. The cosmetic container of claim 10 further comprising an applicator secured to the applicator end.

12. The cosmetic container of claim 11 wherein the applicator is a twisted wire core mascara brush.

* * * * *